US006510886B2

(12) United States Patent
Bettio et al.

(10) Patent No.: US 6,510,886 B2
(45) Date of Patent: Jan. 28, 2003

(54) HEADER AND REMOVABLE PIN, USED PARTICULARLY FOR FLY SCREENS AND FLY SCREEN ASSEMBLIES

(75) Inventors: Denis Bettio, Marcon (IT); Loris Bettio, Marcon (IT)

(73) Assignee: Bettio Group Srl, Marcon (IT)

( * ) Notice: Subject to any disclaimer, the term of this patent is extended or adjusted under 35 U.S.C. 154(b) by 0 days.

(21) Appl. No.: 09/771,535

(22) Filed: Jan. 29, 2001

(65) Prior Publication Data

US 2001/0013397 A1 Aug. 16, 2001

(30) Foreign Application Priority Data

Feb. 11, 2000 (IT) ..... TV20000A0016

(51) Int. Cl.[7] ..... E06B 9/56

(52) U.S. Cl. ..... 160/318; 160/323.1; 242/375; 248/267

(58) Field of Search ..... 160/318, 323.1, 160/324, 321, 313; 242/375; 248/267

(56) References Cited

U.S. PATENT DOCUMENTS 704,546 A * 7/1902 Kinnear
1,363,746 A * 12/1920 Nossek
1,775,364 A * 9/1930 Holt et al.
2,614,629 A * 10/1952 Bleibtreu
3,115,927 A * 12/1963 Znamirowski
4,009,745 A * 3/1977 Erpenbeck
4,399,857 A * 8/1983 Honma
5,351,743 A * 10/1994 Jackson
5,542,464 A * 8/1996 Shiina
5,669,432 A * 9/1997 Nesenson et al.
5,975,186 A * 11/1999 Day
6,173,825 B1 * 1/2001 Liu
6,415,845 B2 * 7/2002 Cattaneo

* cited by examiner

*Primary Examiner*—Blair M. Johnson
(74) *Attorney, Agent, or Firm*—Harrison & Egbert

(57) ABSTRACT

Header to support one end of a rewind roll and to close off at least one end of the casing, used particularly for fly screens, includes:

a bottom from which, along the perimeter of the side close to the casing, there is a discontinuous border that protrudes, with a number of seats for fitting the corresponding end of the said header; and a flat, monolithic part formed in the said bottom that protrudes downwards, with holes formed on the surface in order to fasten it to the uprights of an opening;

wherein, in a bottom, there is a central hole with a key-way into which the end of a pin is connected and thus fixed to the part of the header. The end is mushroom shaped and is flexible, and fits into a hollow in the rear part, that is, on the side on the outside of the header.

14 Claims, 2 Drawing Sheets

HEADER AND REMOVABLE PIN, USED PARTICULARLY FOR FLY SCREENS AND FLY SCREEN ASSEMBLIES

BACKGROUND OF THE INVENTION

1. Field of the Invention

The aim of this invention is a header and removable pin arrangement, used particularly for fly screens.

The invention has particular, but not necessarily exclusive, application in the fixture accessories sector, such as fly screens, roller blinds and sun blinds.

2. Description of the Related Art

Fly screens are divided into two categories. The first type is made to measure, manufactured according to the dimensions required for a given client, delivered to the said client and installed by a specialised installation technician. The other type is sold in kit form, and is the type that is most widely available on the market.

The latter type of fly screen is reasonably efficient and economic and is the type at which this invention is mainly aimed. It is far more widespread on the market, and large quantities of components have to be fabricated and transported by the manufacturing companies, especially when dealing with overseas markets. The "do-it-yourself" concept is widely used and offers a product that satisfies most normal requirements, although it is not up to the standards of the made-to-measure type. Both of the examples mentioned have certain components in common, such as the casing, which is generally made from extruded aluminium bar. It is used to contain the rewind mechanism for the fly screen, roller blind or sun blind, and the manual version has a corresponding loaded return spring. The ends of the casing are sealed by special plates or headers, which are supplied in two different versions, a fixed type or together with counter-plates or caps that can be regulated.

There are obviously a number of variations, although they are very similar to the systems described, and are just as common in fly screens as in roller blinds and sun blinds. One of these variations is a lower quality fly screen without the aforementioned return spring inside its mechanism. They differ from the first type in that they are manually operated both for unwinding and rewinding the fly screen. In this case, a typical example uses a closed-loop chain that engages a cog fixed on the relative rewind roll contained inside a casing for unwinding and rewinding the fly screen, roller blind or sun blind in a controlled manner.

These solutions foresee the fabrication of structures, for example fly screens, which are made up as follows:

- a casing;
- a rewind roll contained inside the said casing with each end supported by a pair of headers, at least one of which runs freely on its relative support pin which is, in turn, joined firmly to the said header, and with the said headers joined to the ends of the casing;
- a helicoidal torsion spring positioned co-axially to the said rewind roll, with one end fastened to a support means inside the roll that is free to slide longitudinally, and the other end firmly fastened to a support pin fastened to the header that forms the tensioning means;
- a rod positioned co-axially to the said helicoidal spring, with one end inserted in the middle of the support means inside the roll that is free to slide longitudinally, and the other end embedded in the support pin fastened to the header that forms means for putting the spring in tension.

Each header, respectively the right one and the left one, is made up of a monolithic plastic body which has a bottom with a curved, protruding border around the perimeter that presses against the corresponding end of the profile of the casing.

The header usually has an off-centre flat part on the bottom side which, apart from being used to fix it to the wall, holds the upper ends of the guide runners along which the sides of the roller-blind slide.

A standard characteristic of both the right-hand and left-hand headers is that there is a protruding, monolithic, cylindrical pin on one side. The purpose of the pin, as mentioned above, is to support the rewind roll and rewind mechanism, if foreseen, which is made up of a helicoidal spring, a coaxial rod and a mobile support fixed to the rod inside the said rewind roll.

These solutions, regarding the use of headers with monolithic pins, have a number of drawbacks that can not be overlooked.

The first drawback regards the complex stock management procedures that are required, since it is necessary to organise the headers according to left and right-hand sides and according to the various colours of the casing. In this specific case, the production programme during the winter foresees the manufacture of a certain number of headers according to the various colours, of the casings. The headers are then assembled firstly to the rewind roll and then to the casing, until the final product is ready. There is a marked lack of flexibility with this type of manufacturing process, since a certain header colour may not be present in a given production cycle or there may be a surplus of another header colour, operations which require constant monitoring and, because of possible misunderstandings, may even lead to delays in their delivery. A further drawback is the costs involved in having to keep a large stock of materials constantly available for every header colour required, costs which, because of the production planning required, are very high and end up weighing heavily on the final product.

A second drawback regards the fact that at least two types of header have to be kept in stock, apart from the standard type for one of the ends of the casing, that is, a first type for the assemblies that have a rewind mechanism such as a traditional spring in tension, and a second type for those assemblies that have no rewind mechanism and are completely manually operated. This type of organisation is due to the fact that the first type of header is monolithic and has only the protruding pin to which the rewind roll is attached, while the second type is assembled together with a wheel or pulley arrangement for the rewind roll which is specially designed. for use with this type of header.

The third drawback regards the assembly phase of the casing. In the case of a fly-screen with a helicoidal rewind spring, the spring is put in tension by rotating the header in one direction before inserting the assembly in the casing. It is easy to imagine that this operation is quite complex and difficult, and requires quite a large amount of time and labour. In view of the drawbacks mentioned above, alternative solutions are obviously required and the aim of the invention described herein is to overcome the aforementioned drawbacks.

BRIEF SUMMARY OF THE INVENTION

This and other aims are achieved through the use of this invention according to the characteristics in the attached claims, solving the problems described by means of a header to support one end of a rewind roll and to close off at least one end of the casing, used particularly for fly screens, and including:

a bottom from which, along the perimeter of the side close to the casing, there is a discontinuous border that protrudes, with a number of seats for fitting the corresponding end of the said header;

a flat, monolithic part formed in the said bottom that protrudes downwards, with holes formed on the surface in order to fasten it to the uprights of an opening;

wherein, in said bottom there is a central hole with a key-way into which the end of a pin is connected and thus fixed to the said part of the header. The end is mushroom shaped and is flexible, and fits into a hollow in the rear part, that is, on the side on the outside of the said header.

In this way, through the creative contribution of the system, which leads to an immediate technical progress, various advantages are achieved.

The first and, without a doubt, the most important advantage is that only a single type of header that is fastened to the corresponding end of the casing is required, and that it can be tinted as and when required. In fact, the said headers may be made from one single colour and, since no pre-assembly operation with the rewind roll is required, they are tinted only when a certain order has to be completed. This means that stock management is much simpler, and it is no longer necessary to have headers in various colours in stock, but only a single type.

What is more, all the rewind mechanisms, in this case pre-assembled helicoidal springs, will all be the same and the phase in which they are coupled with their respective headers will no longer be required, leading to a reduction in the space required and the amount of material transfer. In this way, stock management is much simpler, completion of orders is much quicker with relatively simple organisational procedures, and with orders being met on time.

A second advantage concerns the flexibility of this type of header, in that by connecting a pulley to it, it may also be used for the type of fly-screen that uses a closed-loop chain system together with the pulley for rotating the rewind roll, rather than the type that uses a spring-loaded rewind mechanism.

A further important advantage is that the end of the pin fastened to the header has a coaxial slot where a tool can be inserted in order to put the spring in tension by a simple rotary movement, rather than with previous versions where the entire header has to be rotated.

These and other advantages will be shown in the following detailed description and drawings of at least one preferred application of the system, which is to be considered merely an illustration and not a limitation.

DETAILED DESCRIPTION OF THE INVENTION

Figure 1:
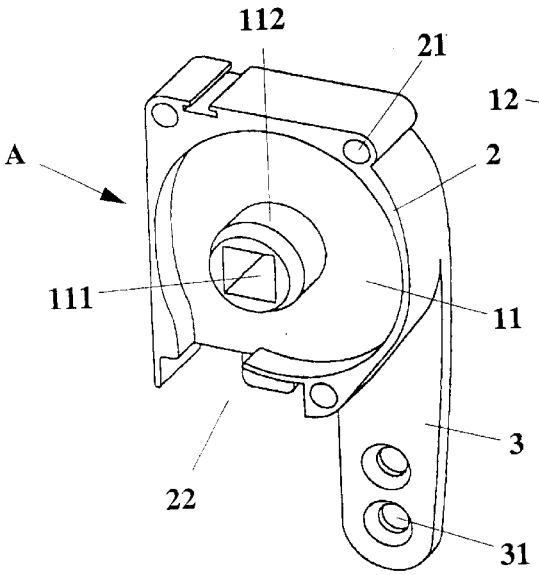
FIG. 1 is a three-dimensional, front view of one of the two headers, without the connecting pin, used for holding the rewind roll and sealing the casing (not shown).
Figure 2:
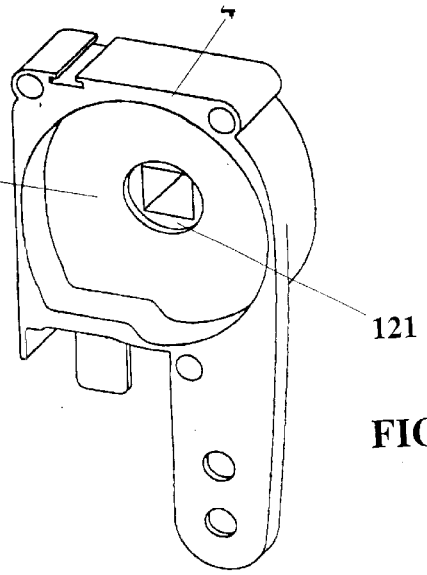
FIG. 2 is a three-dimensional view of the rear side of the portion of header illustrated in the previous drawing.
Figure 5:
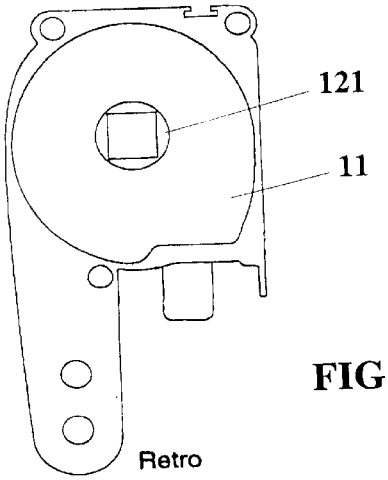
FIGS. 5 and 6 are views of the back and the opposite side of the portion of header shown in FIG. 1.
Figure 6:
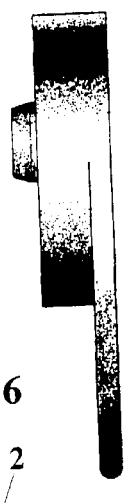
Figure 4:
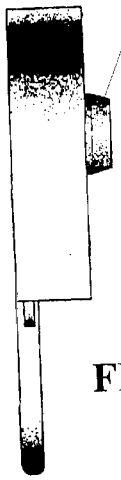
FIGS. 3 and 4 are, respectively, front and side views of the portion of header illustrated in FIG. 1.
Figure 3:
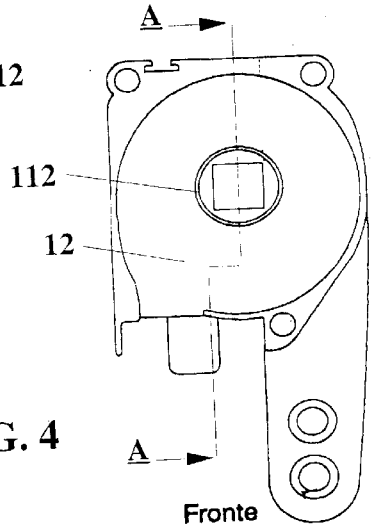
Figure 7:
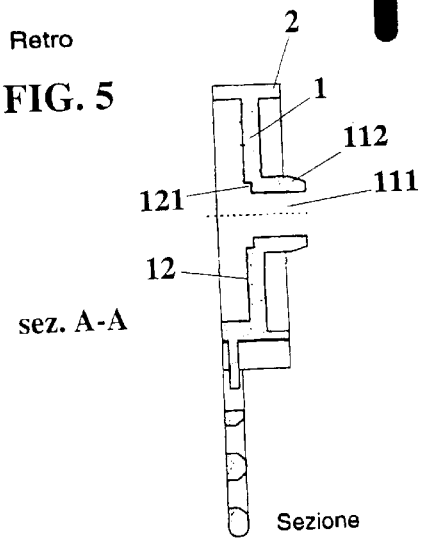
FIG. 7 is an asymmetrical, longitudinal, sectional view along section A—A in FIG. 3.
Figure 8:
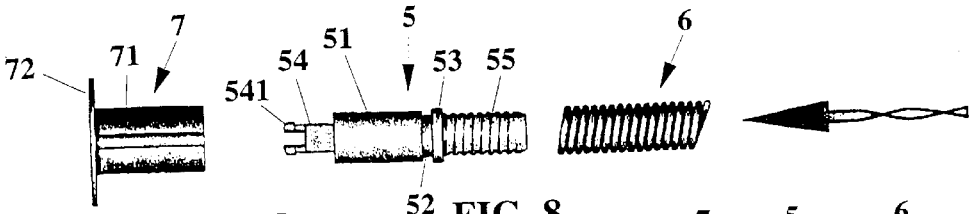
FIG. 8 is an exploded, side view of the components that join one end of the rewind roll (not shown), respectively the end of the spring, the pin and the support bush used for holding the end of the roll.
Figure 9:
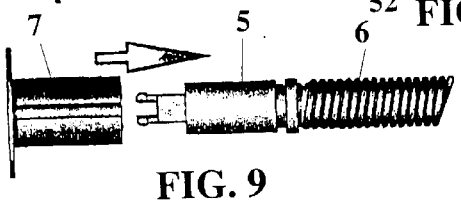
FIGS. 9 and 10 are, respectively, illustrations of two of the phases regarding the assembly of the components shown in FIG. 8.
Figure 10:
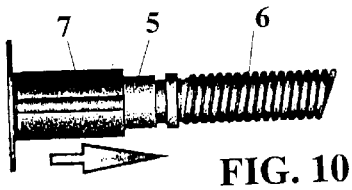
Figure 11:
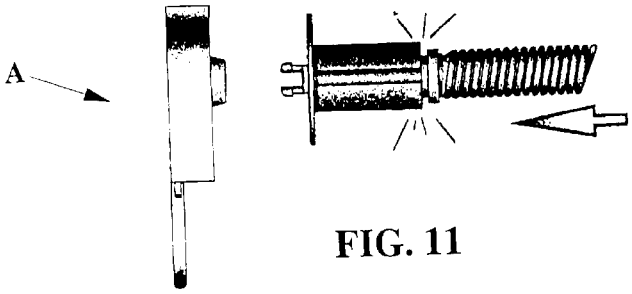
FIG. 11 illustrates a phase of the assembly shown in FIGS. 8 to 10.
Figure 11A:
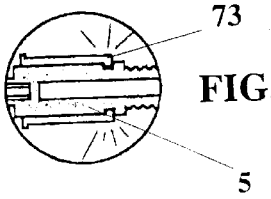
FIG. 11A is a detailed illustration of the pin/roll support assembly.
Figure 12:
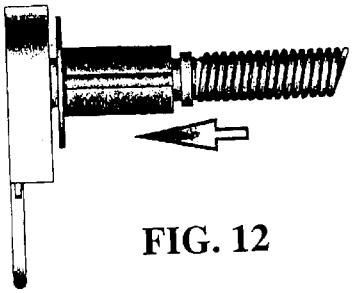
FIG. 12 illustrates a phase of the assembly shown in FIGS. 8 to 10 joined to a header used for fastening the support pin.
Figure 12A:
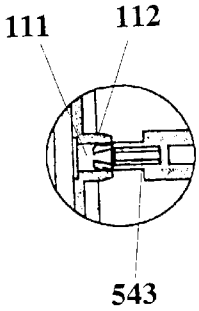
FIG. 12A is a detailed illustration regarding the phase of the insertion of the end of the pin used for connecting it to its relative header.
Figure 13:
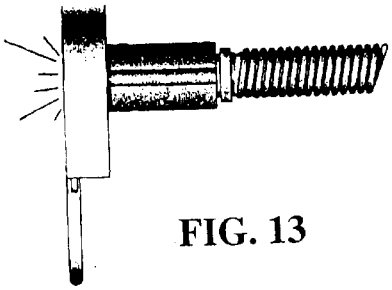
FIG. 13 shows the components shown in FIGS. 8 to 10 assembled with the header.
Figure 13A:
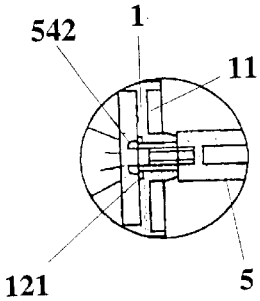
FIG. 13A shows a detail of the coupling shown in the previous drawing.

By referring to the illustrations, a vertical fly screen includes at least two runners that act as guides fastened along each vertical side of the fitting to be equipped, and a casing, made up of extruded aluminium for example, positioned at the upper part, and which contains the fly screen, roller blind or sun blind. Inside the said casing, there is a rewind roll. The said rewind has either a rewind mechanism or, on one side, a closed-loop chain in order to rotate a wheel that is fixed to the said roller.

Going further into detail, the casing has headers at its ends, which are used to support and link the rewind roll and relative rewind mechanism. At least one of these two headers is made up of a monolithic header (A) that seals off one corresponding end of the casing. The header is made of a plastic body with a bottom (1) with one side (11) facing the inside of the casing, while the opposite side (12) faces the outside. Around the perimeter of the said side (11) of the bottom (1) there is a border (2) with a varying thickness that sticks out and that, around the inside perimeter, forms a more or less circular shape. In the border (2), and in correspondence with three of the four corners of the header (A), there are holes (21) in order to fasten the said header (A) to the end of the casing. Along the perimeter of the lower, round part of the header, the border (2) has an opening (22). The purpose of this opening is to allow the relative chain to pass back and forth which, in the type without a return spring, engages the upper part of the drive wheel on the rewind roll. There is also a protruding part (3) which comes away at an angle from one side of the aforementioned upper portion of the header (A) and goes towards the lower part. The end of this piece is rounded and has two holes (31) for fixing the header (A) to the wall.

There is a square hole (111) positioned centrally with respect to the said side (11), and a circular sleeve (112) with an inclined leading edge. On the opposite side (12) of the bottom (1) there is another protruding border (4) so that the surface (12) re enters with respect to the border (4). In correspondence with the perimeter of the square hole (111) there is a seat (121) to ease the locating of the pin (5) fixing means.

The pin (5) is made up of a monolithic body with a central portion that is cylindrical (51) interrupted by an annular groove (52) and a ring (53). In correspondence with one of the ends of the said monolithic body (5) there is a mushroom-shaped portion (54), with the diameter of the base smaller than that of the central portion (51). The said mushroom-shaped portion (54) is flexible and has two fins (541) which deflect and, in correspondence with each end, there is a holding tooth (542). The said end (54) also has a deep, axial seat (543) for a tool in order to put the return spring (6) in tension, if foreseen. In order to hold the end of the spring (6), on the other side (55) of the pin (5) there is a specially shaped helicoidal portion.

When the spring (6) has been fixed to the pin (5) this assembly is fastened to a tubular body (7) which has a surface (71) with longitudinal grooves to hold the relative rewind roll firmly with, on one side, an angular, orthogonal shoulder (72) that is used to guide and hold the screen laterally. In order to fasten the tubular body (7) to the coaxial pin (5), the end of the tubular body has an annular holding tooth (73), which fits inside the corresponding groove (52) along the pin (5). With this system, the end of the mushroom-shaped piece (54) comes out from one side of the tubular body (7), leaving a space between the mushroom and the inside surface of the tubular body (7) which, by joining the assembly to the header (A), is used to hold the collar (112) that sticks out from the side (11) of the bottom (1).

At this point, the pin (5), spring (6) and tubular body (7) assembly is thus joined to the header (A), so that the end of the mushroom-shaped portion (54) can be inserted through the hole (111) in the bottom (1). In this way, the flexible fins (541) go past the said hole (112) and deflect back and sit with the tooth (542) along the seat (121) formed on the side (12) of the header (A).

In a variation of the system, which foresees a casing with a chain for rotating the rewind roll, only a different type of tubular body (7) is used. In this case, the said tubular body (7), positioned close to the shoulder (72), forms a shaped surface on the side opposite the rewind and limit of the edge of the screen, fixed to the shoulder, (72) that engages and guides the closed-loop chain, and that comes down through the seat (22) along the header (A).

We claim:

1. An apparatus for supporting a casing of a fly screen comprising:

a header having a side and a discontinuous border extending around a perimeter of said side, said side suitable for receiving an end of the casing therein, said discontinuous border having a plurality of holes formed therein, said header having a flat part formed therein and extending outwardly therefrom, said flat part having holes formed in a surface thereof, said header having a central hole with a key-way formed therein;

a rewind-roll support pin removably received in said side of said header, said support pin having means formed at an end thereof for fastening said support pin to said header, said support pin being a monolithic body having a cylindrically-shaped central portion, said central portion having an annular groove and a ring element formed therearound, said support pin having a mushroom-shaped end and a coupling end, said central portion located between said mushroom-shaped end and said coupling end, said mushroom-shaped end being flexible and resiliently engaging said key-way of said header.

2. The apparatus of claim 1, said mushroom-shaped end engaging an outer surface of said header.

3. The apparatus of claim 1, said discontinuous border having a slotted opening formed therethrough.

4. The apparatus of claim 1, said central hole being a square hole extending through a circular sleeve having an inclined leading edge.

5. The apparatus of claim 1, said header having an outer side with a perimeter border, said central hole opening to said outer side, said central hole having a seat formed therearound at said outer side receiving a portion of said mushroom-shaped end therein.

6. The apparatus of claim 1, said mushroom-shaped end having at least two fins which are deflectable with respect to each other each of the fins having a holding tooth at an end thereof.

7. The apparatus of claim 1, said mushroom-shaped end having a base connected to said central portion of a smaller diameter than a diameter of said central portion.

8. The apparatus of claim 1, said mushroom-shaped end having an axial groove formed thereinto.

9. The apparatus of claim 1, further comprising:

a tubular body having a surface with longitudinal grooves formed therealong and an annular outwardly extending shoulder formed at an end thereof, said support pin being coaxial with said tubular body.

10. The apparatus of claim 9, said tubular body having an inwardly extending annular holding tooth at an end opposite said shoulder, said holding tooth received within said annular groove of said support pin.

11. The apparatus of claim 9, said mushroom-shaped end having a portion extending outwardly of one side of said tubular body.

12. The apparatus of claim 1, said mushroom-shaped end having flexible fins with a tooth extending outwardly therefrom, said tooth engaging a groove formed at an end of said central hole on an opposite side of said header.

13. The apparatus of claim 1, said central hole being square.

14. The apparatus of claim 1, further comprising:

a helicoidal tension spring positioned coaxially on said support pin.

* * * * *